United States Patent [19]

Phinney

[11] 4,113,077

[45] Sep. 12, 1978

[54] MARINE PROPULSION CONTROL SYSTEM WITH ENGINE IDLE BOOST

[75] Inventor: John M. Phinney, Milwaukee, Wis.

[73] Assignee: The Falk Corporation, Milwaukee, Wis.

[21] Appl. No.: 759,390

[22] Filed: Jan. 14, 1977

Related U.S. Application Data

[63] Continuation-in-part of Ser. No. 715,680, Sep. 19, 1976.

[51] Int. Cl.[2] ..... F16D 67/00

[52] U.S. Cl. ..... 192/.098; 192/.084; 74/874

[58] Field of Search ..... 192/.084, .096, .098; 74/858, 874, 878

[56] References Cited

U.S. PATENT DOCUMENTS

| | | | |
|---|---|---|---|
| 2,524,487 | 10/1950 | Stevens | 192/.098 X |
| 2,649,173 | 8/1953 | Stewart | 192/.084 |
| 3,543,891 | 12/1970 | Mathers | 192/.098 X |
| 3,727,737 | 4/1973 | Phinney | 192/.098 |

*Primary Examiner*—Benjamin W. Wyche
*Attorney, Agent, or Firm*—Quarles & Brady

[57] ABSTRACT

A control system for air actuated ahead and astern clutches and the engine speed governor of a marine propulsion system. Upon actuation of a throttle lever controlling a throttle valve, a selector valve is first actuated to operatively connect one or the other of the ahead or astern clutches to the control. Further movement of the throttle lever causes a relay valve to supply air at a pressure proportional to the throttle position to a main control valve which passes such air pressure to the selected clutch until a first control pressure is reached. Thereafter, air from the supply is supplied at a programmed rate to the selected clutch to continue inflation of the clutch until a second control pressure is reached whereupon a boost valve is actuated to connect full supply air pressure to the selected clutch. A governor control valve also receives the air output of the relay valve proportional to throttle position. When the pressure within the selected clutch exceeds the level of a biasing spring within the governor control valve, the governor valve is actuated and the air output proportional to throttle position is applied to the engine speed governor. Prior to the actuation of the governor valve, air output proportional to throttle position is passed by a regulator valve through the governor valve and to the engine speed governor. The air output pressure which the regulator valve passes is limited to a preselected, adjustable maximum so as to limit the maximum engine boost speed.

4 Claims, 5 Drawing Figures

MARINE PROPULSION CONTROL SYSTEM WITH ENGINE IDLE BOOST

This application is a continuation-in-part of application Ser. No. 715,680, filed Aug. 19, 1976.

BACKGROUND OF THE INVENTION

The invention relates to ship propulsion systems of the type incorporating air actuated clutches, and more specifically to an improved control system which provides an automatic engine speed advance during the engagement cycle for the pneumatically operated clutches.

A common form of marine propulsion system employs ahead and astern air actuated clutches for connecting the prime mover to a reversing reduction gear unit for each propeller. The air actuated clutches are engaged by the inflation of an inflatable rubber and fabric air gland bonded to an outer steel rim. Friction lining on the inner surface of the gland engages a cylindrical clutch drum when the gland is inflated. When the gland is fully deflated there is no clutch engagement, and when the gland is fully inflated there is complete clutch engagement. Between these two extremes the degree of clutch engagement corresponds to the amount of inflation of the gland.

In certain propulsion systems a controlled slip of the clutch is provided by controlling the degree of clutch engagement. Such controlled slip permits a lower propeller shaft speed than would be otherwise available at engine idle with full clutch engagement. This is particularly advantageous for maneuvering the ship when docking or traveling in a congested area. An example of such a controlled slip system is found in my earlier U.S. Pat. No. 3,727,737 issued Apr. 17, 1973, for "Pressure Modulating System for Reversing Clutches and Throttle Control".

In the system of my earlier patent, I provided a pneumatic clutch control assembly for a ship's propulsion system that was sequentially operated to regulate the inflation of ahead and astern air inflatable clutches and to also control the prime mover speed. The control assembly was actuated by a single throttle lever located on a pilot house control stand. Movement of the lever in one direction provided forward rotation of a propeller at a speed which increased with handle travel away from neutral. Movement of the handle in the opposite direction provided astern rotation of the propeller with speed increasing as the handle was moved farther from neutral. The center position provided a neutral setting in which the engine was disconnected from the propeller and no power was transmitted, although the engine continued to idle.

The single lever control of both direction and speed was accomplished in the following manner: As the lever was pivoted in either direction from the neutral, air was supplied to a selector valve which selected one or the other of the ahead and astern clutches. Thereafter, and up to a first control pressure, air pressure proportional to the position of the lever away from neutral fed through a first valve to the clutch and thereby began inflating the selected clutch. During this time the engine would remain at idle speed. After a first control pressure was reached, the first valve was piloted and it connected a second path for air to the clutch. This second path had provision for an initial programmed rate of feed of air to the clutch through a choke valve so as to softly inflate the clutch. Upon reaching a second higher control pressure, full supply air pressure was connected to the clutch. After the first control pressure was reached, the continued inflation of the clutches was not dependent upon the position of the throttle lever.

When the air pressure within the clutch rose to a predetermined level, the control of my earlier patent piloted a governor valve which, in effect, connected the throttle lever control to the speed governor of the engine so that the pressure supplied to the governor directly corresponded to the position of the throttle lever and the speed could be controlled by movement of the throttle lever. The throttle lever setting determined only the final operating speed and direction and all intermediate steps of clutch engagement and inflation and engine governor speed were handled automatically by the control system.

Certain engines used for marine propulsion will stall at idle speed when the clutch is engaged. This problem is solved by increasing the speed of the engine during the period of time in which the clutch is engaged. The increased engine speed increases the engine torque capacity and the inertia of the engine while the clutch is being engaged and thereby avoids stalling of the engine.

Present control systems which provide for the automatic increase in speed of the engine during the time of clutch engagement have accomplished this by automatically accelerating the engine to a specific rpm for a specific period of time. While such control systems allow for adjustment of both the specific rpm to which the engine is increased and the period of time of the engine speed increase, the available ranges of speed and time are arbitrary and are not inherently related to any specific operating conditions for the propulsion system. Thus, if the throttle lever is set for a speed which is less than the increased speed which the control will call for during clutch engagement, the engine will be accelerated to a speed beyond that at which it will run after the clutch is engaged. The time period can also continue well beyond the clutch engaging cycle thereby resulting in a surge condition where the vessel accelerates too quickly and not under control of the vessel operator.

I have provided by the present invention an improved control system which provides for an increase in the speed of the engine during the clutch engagement, but in which the engine speed boost timing is governed specifically by the clutch engaging cycle and the engine boost speed cannot exceed the speed that the engine is set to run at after the clutch engaging cycle is completed.

SUMMARY OF THE INVENTION

In accordance with my invention, I provide a control system for a ship's propulsion system which includes an air activated clutch for connecting a prime mover to a drive train and in which an air pressure signal proportional to a throttle lever position is fed to throttle speed governor for controlling the prime mover speed, the feeding of said air pressure signal being first controlled by a speed boost valve until the pressure within the clutch reaches a level sufficient to actuate a throttle governor control valve which thereafter controls the feeding of said air pressure signal.

Further in accordance with my invention, the speed boost valve feeds through the governor control valve until such governor control valve is actuated and the speed boost valve is thereafter operatively disconnected from the throttle speed governor.

Also in accordance with my invention, the speed boost valve will limit the air pressure signal fed by it to the throttle speed governor to a preselected, adjustable maximum pressure.

It is a principal object of this invention to provide a control system for a pneumatically actuated marine propulsion system in which the engine speed will be automatically boosted beyond idle speed during clutch engagement. It is another object of the invention to limit such engine speed boost at low speeds to the speed selected by the operator.

The foregoing and other objects and advantages of the invention will appear in the detailed description which follows. In the description reference is made to the accompanying drawings which illustrate a preferred embodiment of the invention.

DESCRIPTION OF THE PREFERRED EMBODIMENT

Figure 1:
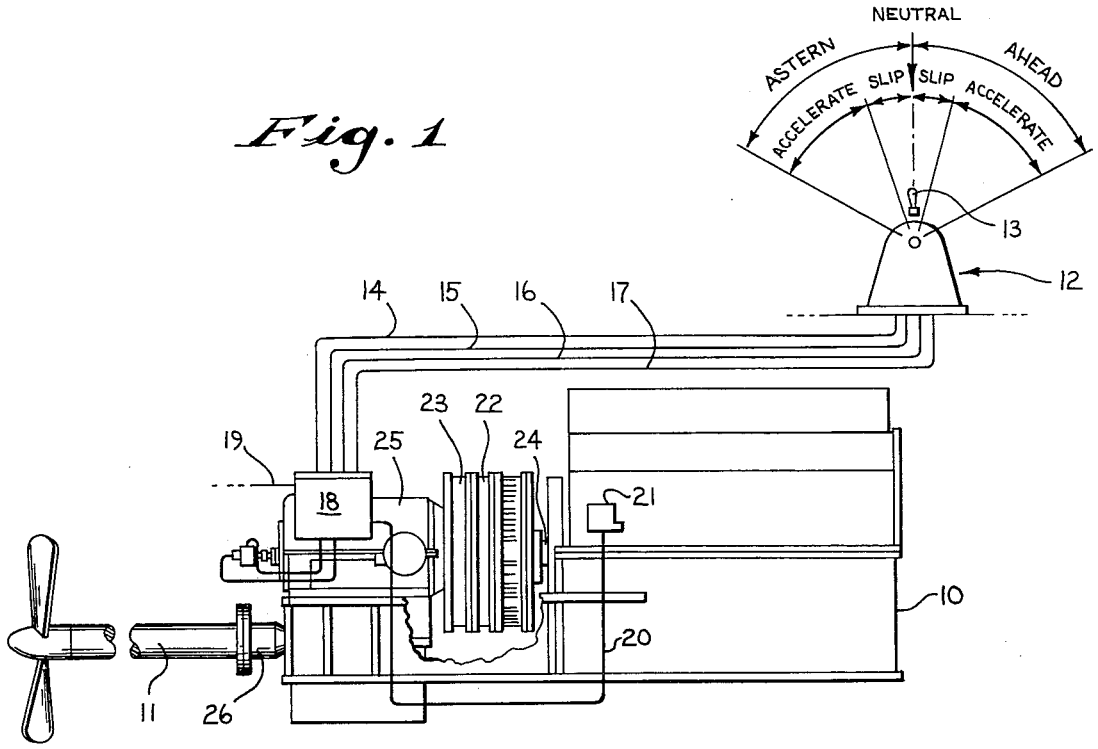
FIG. 1 is a schematic representation of a ship's propulsion system with which the improved control system of the present invention may be employed.

FIG. 1 illustrates a known arrangement of a pneumatically controlled marine propulsion system which controls the speed of the ship's engine 10 and its connection to the propeller shaft 11. The propulsion system includes a pilot house control stand 12 which mounts a throttle lever 13 controlling a throttle valve which connects four air lines 14, 15, 16 and 17 to a control panel assembly 18.

The control panel assembly 18 is connected to the ship's pressurized air source by a main supply line 19. The panel assembly 18 under control of the throttle lever 13 functions to regulate the supply of air through a line 20 to a throttle speed governor 21 for the engine 10 and also functions to control the supply of air to an ahead clutch 22 and an astern clutch 23. The clutches 22 and 23 act to transmit torque from the engine 10, through a drive shaft 24, to the input of a reverse reduction gear train 25 whose output shaft 26 is connected to the propeller shaft 11. The engine 10 is unidirectional and its output is high in speed but low in torque. The reverse reduction gear train 25 functions to reduce the rotational speed and to increase the torque, and also to reverse the direction of drive when required.

The throttle lever 13 is movable forwardly or rearwardly from a neutral position as indicated in FIG. 1 to select the ship's direction of travel. The amount of movement of the throttle lever 13 from neutral regulates the degree of clutch engagement and thereafter the engine speed.

Figure 2:
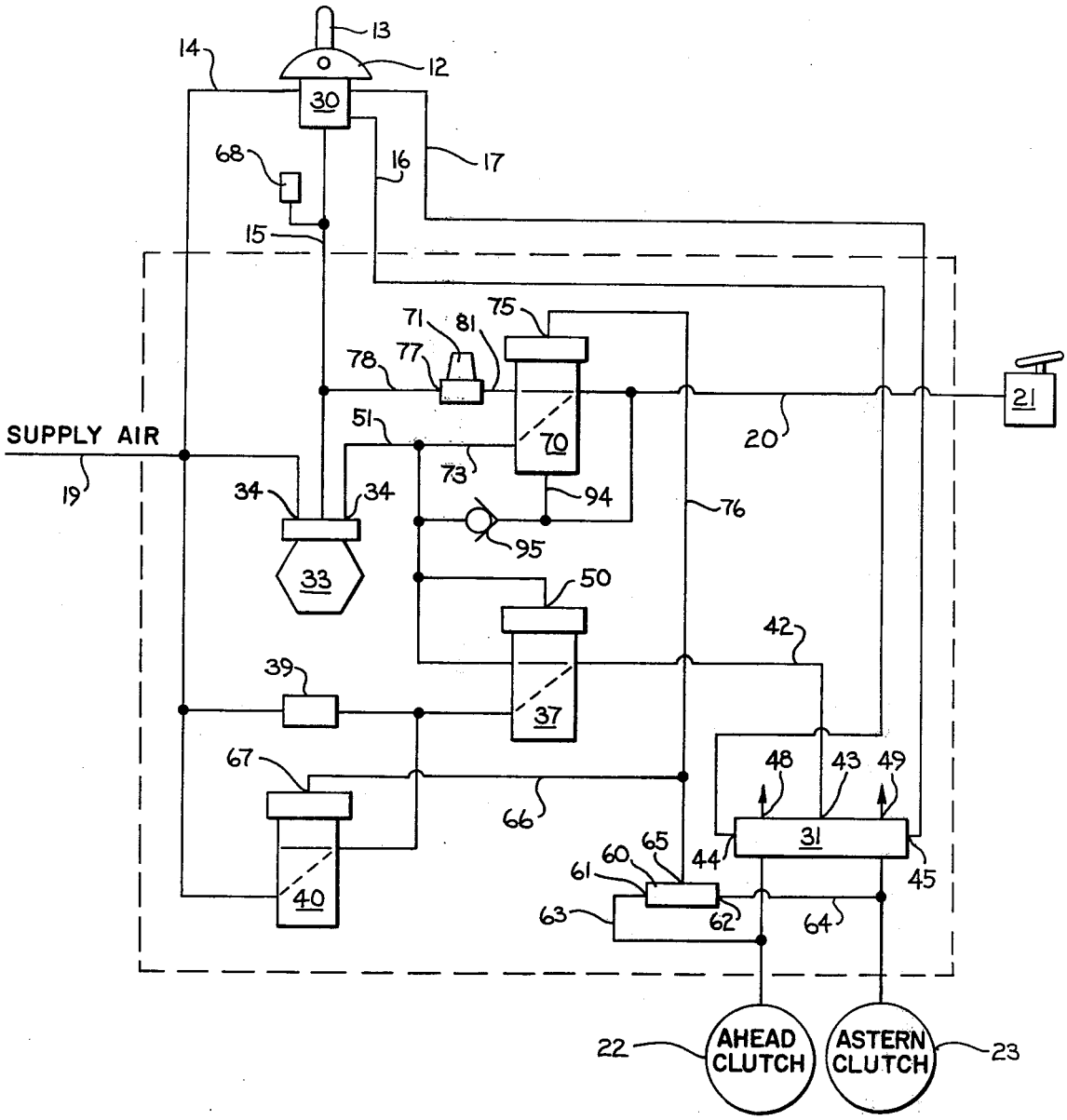
FIG. 2 is a schematic representation of the control system incorporating the present invention and connected to operate the propulsion system of FIG. 1.

Referring to FIG. 2, the throttle lever 13 directly controls a pressure control and directional flow control throttle valve 30. The throttle valve 30 is of known construction and is operative to furnish full supply air pressure from the supply line 14 which leads from the supply air line 19 to one or the other of the piloting air lines 16 and 17 of a clutch selector valve 31. The throttle valve 30 also supplies graduated pressure to the air line 15 and the graduated pressure is always proportional to the degree of movement of the lever 13 away from neutral. The lever 13 is equipped in a known manner with an adjustable friction brake (not shown) which holds the lever in any selected position.

If the lever 13 is pivoted at least five degrees forward or backward from its neutral position, the throttle valve 30 will connect the supply line 14 to the appropriate piloting air line 16 or 17 to thereby actuate a four-way selector valve 31 for selection of the appropriate ahead or astern clutch 22 or 23. This movement to select the desired clutch for the desired direction of movement is not sufficient to cause full engagement of the clutches selected. Instead, the initial movement from the neutral position places the propulsion system in a slip condition in which there is insufficient air in the selected clutch to prevent clutch slippage even when the ship's engine 10 is operating at idle throttle speed.

The line 15, whose air pressure is proportional to lever position, leads to the pilot port 32 of a relay valve 33 whose inlet port 34 is connected to the supply air line 19 and whose outlet port 35 is connected to the inlet port 36 of a master control valve 37. The relay valve 33 is designed to relay or repeat large quantities of supply air from the supply line 19 to its outlet port 35 at a pressure level which is the same as the air pressure in the piloting line 15.

The master control valve 37 has a second inlet port 38 which is connected to a second air branch leading from the air supply line 19. The second branch includes a choke valve 39 and a boost valve 40 connected in parallel across the supply air line 19 and the second inlet port 38 of the master control valve 37.

An outlet port 41 of the master control valve 37 connects to a third air branch which comprises an operating line 42 connected to the inlet port 43 of the clutch selector valve 31. The clutch selector valve 31 has two pilot ports 44 and 45 which are connected to the respective piloting lines 16 and 17 leading from the throttle valve 30. The clutch selector valve 31 also has a pair of outlet ports 46 and 47 and a pair of exhaust ports 48 and 49. The outlet ports 46 and 47 are connected respectively to the ahead clutch 22 and astern clutch 23.

After the throttle lever 13 has been moved five degrees forwardly or rearwardly of its neutral position to cause the piloting of the clutch selector valve 31 to connect a selected one of the outlet ports 46 and 47 with the inlet port 43, air under pressure will pass through the master control valve 37 and the clutch selector valve 31 to begin to inflate the selected clutch 22 or 23. During the inflation of one of the clutches, the other clutch will be deflated through its corresponding exhaust port 48 or 49. When the control lever 13 is in its neutral position, both clutches 22 and 23 are exhausted to the atmosphere through their respective exhaust ports 48 and 49.

The master control valve 37 is a pneumatic-piloted, pressure sensitive valve that changes the air passages within itself when air at a first control pressure, or higher, is supplied to its piloting port 50. The piloting port 50 is coupled to an operating line 51 which leads from the outlet port of the relay valve 33 to the inlet port 36 of the master control valve 37. Thus, air at the same pressure level is supplied to both the inlet port 36 and the pilot port 50 of the master control valve 37 and this pressure is at the same level as that supplied to the relay valve 33 by the line 15 and is representative of the position of the throttle lever 13. So long as the pressure supply through the operating line 51 is less than a first control pressure which is the piloting pressure for the master control valve, that pressure supply will be directed through the master control valve 37 to the operating line 42 and thence to the selected clutch 22 or 23.

When the throttle lever 13 is moved to a position from neutral such that the actuating pressure (first control pressure) for the master control valve 37 is exceeded, the master control valve 37 will disconnect the first air branch from the clutches and will instead connect the second air branch to the clutch being controlled. At first, the choke valve 39 will function to permit air to flow from the supply air line 19 through the master control valve 37 and to the operating line 42 at a programmed rate that is determined by the size of the choke valve 39. As a result, the clutch is not abruptly fully inflated but is instead inflated in a controlled and soft manner. There is no flow of air through the boost valve 40 at this time because the boost valve 40 is normally closed and will not open until piloted by the air pressure within the clutch.

The air pressure that controls the piloting of the boost valve 40 is provided by a piloting circuit comprised of a shuttle valve 60 which has a pair of inlet ports 61 and 62 connected by piloting lines 63 and 64, respectively, to the supply lines for the ahead and astern clutches 22 and 23, respectively. The shuttle valve 60 has a single outlet port 65 which is connected via a piloting line 66 to the pilot port 67 of the boost valve 40. The shuttle valve 60 automatically selects and directs the flow of air from the respective one of the clutches 22 and 23 which is being engaged. It will connect either, but not both, of its inlet ports 61 or 62 with its outlet port 65. Thus, air is siphoned from the particular clutch 22 or 23 which is at the highest pressure and is supplied to the pilot port 67 of the boost valve 40. When the air pressure thus supplied, and consequently the air pressure within the inflating clutch, reaches a second control pressure at which the boost valve 40 is set to be piloted, that valve will open to connect the supply air line 19 to the inlet port 38 of the master control valve 37 thereby bypassing the choke valve 39. When this occurs, full supply air pressure is supplied to the operating line 42 and the clutch selector valve 31 so that the selected clutch 22 or 23 will be fully inflated.

The components of the control system thus far described are the same as those described in my earlier U.S. Pat. No. 3,727,737, and are employed to select and provide the controlled rate of inflation of the clutches 22 and 23. In summary, up to a first control pressure which is directly proportional to the movement of the throttle lever 13, air pressure proportional to the lever position feeds through the master control valve 37 to the selected air clutch. After that first control pressure is reached, pressure is fed at a programmed rate through the choke valve 39 to the selected clutch without regard to the continued motion or setting of the control lever 13. After a second control pressure is reached, air at full supply pressure is fed to the selected clutch through the boost valve 40 and the clutch is fully inflated. To deflate, the throttle lever 13 is returned to its neutral position which will cause the selector valve 31 to connect the exhaust ports to the clutches 22 and 23. Air is exhausted from the control line 15 by a bleeder valve 68.

The control panel assembly 18 controls the throttle speed governor 21 by means of a double-piloted throttle governor valve 70 and an engine idle boost regulator valve 71. The throttle governor valve 70 has an inlet port 72 connected by a line 73 to the line 51 leading from the outlet port 35 of the relay valve 33. An outlet port 74 of the throttle governor valve 70 is connected to the operating line 20 for the throttle speed governor 21. The governor valve 70 has a pilot port 75 connected by a pilot line 76 to the outlet port 65 of the shuttle valve 60.

The idle boost regulator valve 71 has an inlet port 77 connected by a line 78 to the line 15 which leads from the throttle valve 30 to the relay valve 33. An outlet port 79 of the idle boost regulator valve 71 is connected to the exhaust port 80 of the governor valve 70 by a line 81.

Since the inlet of the regulator valve 71 is connected to the line 15 which contains air under pressure proportional to the position of the throttle lever 13, and the inlet port 72 of the governor valve 70 is connected to the outlet port 35 of the relay valve 33 which is provided with air under pressure proportional to the throttle lever position, both the governor valve 70 and the regulator valve 71 will be provided with an air pressure signal indicative of the speed at which the engine is to run following engagement of the selected clutch.

Figure 3:
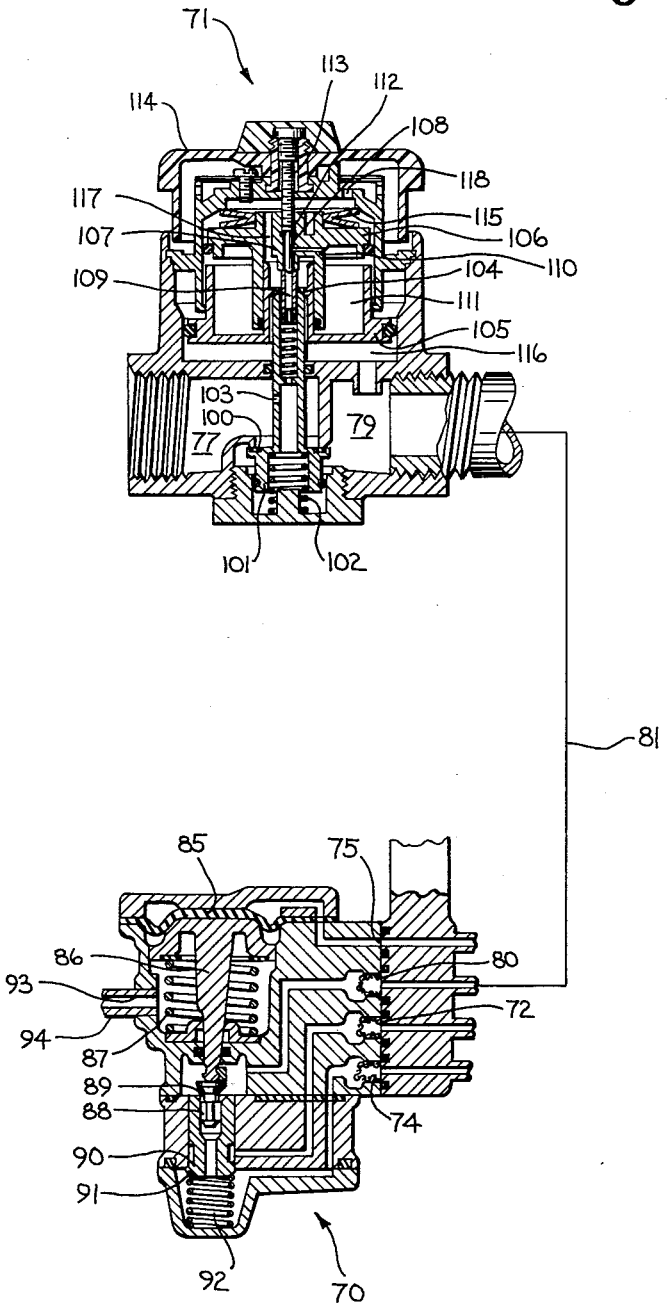
FIG. 3 is a detailed view in section of a governor control valve and of an engine speed boost regulator valve used in the control system of the invention.
Figure 5:
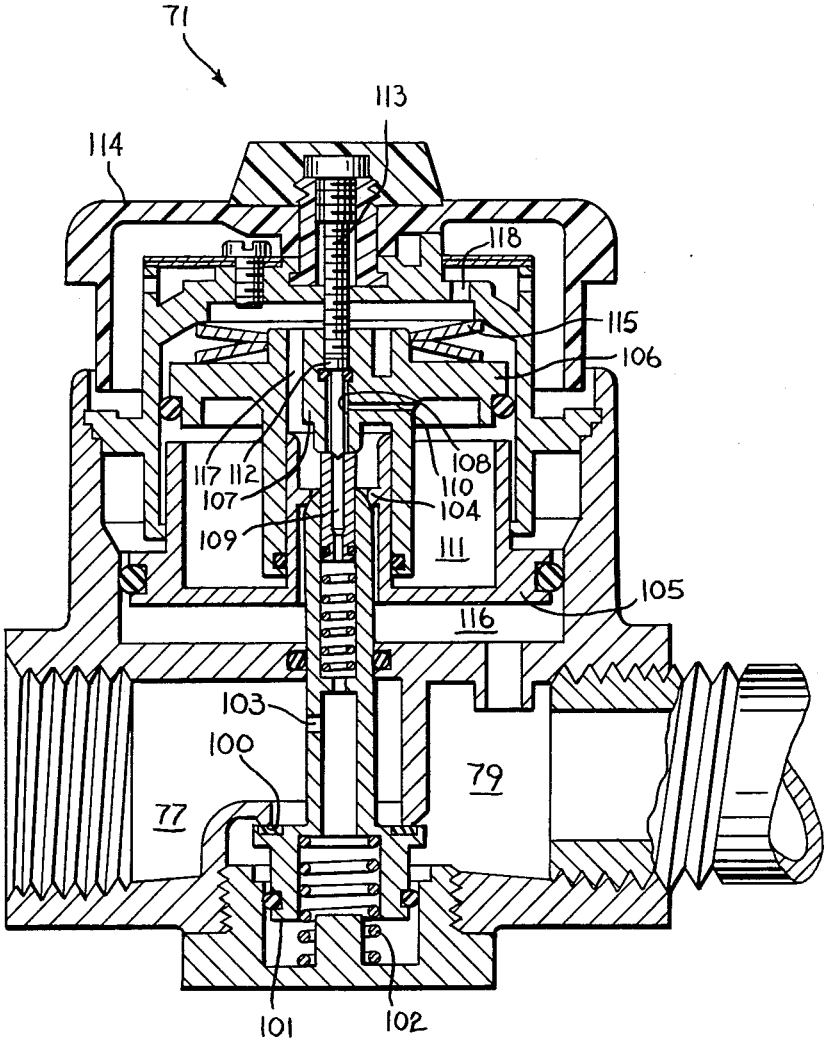
FIG. 5 is a detailed view to an enlarged scale of the engine speed boost regulator valve of FIG. 3.

Referring to FIG. 3 in which the details of construction of the governor valve 70 and regulator valve 71 are shown, the governor valve 70 is a known form of commercially available diaphragm valve. The valve diaphragm 85 is operatively connected to a diaphragm follower 86 which is normally urged upwardly by a spring 87. An exhaust valve 88 is attached to the bottom of the follower 86 and operates against a valve seat 89 formed at one end of a supply valve 90. The supply valve 90 operates against a supply valve seat 91 and is normally biased upwardly into a position against the seat by a supply valve spring 92. The pilot port 75 leads to a chamber above the diaphragm 85. A second pilot port 93 leads to a chamber beneath the diaphragm 85 and is connected by a line 94 to the throttle speed governor operating line 20. The pilot line 94 is also connected through a check valve 95 to the line 51 which supplies the line 73 connected to the inlet port 72 of the governor valve 70.

In the position illustrated in FIG. 3 with the supply valve 90 seated against the seat 91, the governor valve is deactuated and the inlet 72 is closed off by the supply valve 90. However, the exhaust valve 88 is open so that the outlet 74 is connected to the exhaust port 80 and is therefore connected to the outlet port 79 of the regulator valve 71. If pressure admitted through the upper pilot port 75 from the shuttle valve port 65 is sufficient to initially overcome the force of the spring 87 plus the pressure in the governor operating line 20 as reflected at the second pilot port 93, the diaphragm 85 and its follower 86 will move downward, compressing the spring 87 and seating the exhaust valve 88 against the seat 89. At this point the exhaust port 80 will be closed off from the outlet port 74. As downward movement continues, the supply valve 90 moves away from its seat 91 and compresses the supply valve spring 92. This continued movement then connects the outlet port 74 to the inlet port 72. The throttle governor valve 70 has now been actuated and is open to pass to the governor valve 21 from the outlet port 35 of the relay valve 33, an air pressure signal proportional to the position of the throttle lever 13. The air pressure signal proportional to the position of the throttle lever 13 which passes through the governor valve 70 will control the engine speed governor 21 and in this manner the engine speed is controllable by varying the position of the throttle lever 13.

Referring further to FIG. 3, the idle boost valve 71 is a commercially available adjustable regulator valve. The regulator valve 71 has its inlet port 77 separated from its outlet port 79 by a main valve seat 100. A main valve stem 101 seats against the main valve seat 100 under the urgings of a spring 102. The main valve stem 101 is hollow and includes an entrance 103 to its hollow interior which is in communication with the inlet port 77. The upper end of the main valve stem 101 seats against a relief valve seat 104 formed in a lower piston 105. An upper piston 106 is mounted concentric with the lower piston 105 and the main valve stem 101. The upper piston 106 has a stub 107 which includes a central passageway 108. The stub 107 bears against the upper end of a hollow pilot valve stem 109. The upper piston 106 has a lateral passage 110 which communicates between the hollow interior of the pilot valve stem 109 and a control chamber 111 formed between the upper and lower pistons 106 and 105, respectively.

A plunger 112 rides in the central passageway 108 of the upper piston 106 and is adapted to contact and close the upper end of the pilot valve stem 109. The position of the plunger 112 is adjustable by turning an adjustment screw 113 which is connected to an outer dial knob 114. The upper piston 106 is urged downwardly by a Belleville spring 115.

The general operation of the idle boost valve 71 is as follows: If the pressure at the outlet port 79 is less than that applied to the inlet port 77 and is less than the pressure setting of the valve 71, air entering the inlet port 77 will pass through the orifice 103 to the interior of the main valve stem 101 and through the pilot valve stem 109 and out the lateral passage 110 into the chamber 111 between the upper and lower pistons. This path is open because at a pressure beneath the set pressure the plunger 112 will not have closed off the pilot valve stem 109. As the pressure at the inlet increases, the pressure in the chamber 111 will increase thereby moving the lower piston 105 downwardly to cause the relief valve seat 104 attached to that piston to push down the main valve stem 101. When the force of the spring 102 has been overcome, the valve stem 101 will move away from the main valve seat 100 and connect the outlet port 79 to the inlet port 77. At the same time, the pressure in the control chamber 111 is also pushing the upper piston 106 upwardly against the force of the spring 115 above it. This force against the spring 115 will allow the pilot valve stem 109 to move upwardly in contact with the plunger 112 as soon as the set pressure has been reached to thereby close the pilot valve. Thereafter increasing pressure in the inlet port 77 will not be reflected in increasing pressure in the control chamber 111. The pressure in the control chamber 111 will, instead, be balanced against the pressure in a secondary control chamber 116 beneath the lower piston 105. The secondary control chamber 116 is at the same pressure as at the outlet port 79. Thereafter, if the pressure in the outlet 79, and therefore, the pressure in the secondary control chamber 116, becomes greater than the dial setting, it will force the lower piston 105 upwardly thereby allowing the main valve stem 101 to move upwardly and reseat against the main valve seat 100 to close the main valve. Continued pressure increase at the outlet port 79 will force the lower piston 105 further upwardly thereby unseating the relief valve seat 108 and venting excess pressure at the outlet port 79 through the secondary control chamber 116 past the now open relief valve seat 108 and out a vent passage 117 in the upper piston 106 from whence it will vent to the atmosphere through a relief outlet 118 beneath the dial knob.

If supply air pressure in the line 19 is lost for any reason, the maximum governor signal, which is allowed to be transmitted to the line 20 and thus to the throttle speed governor 21, will be reduced in proportion to the falling clutch pressure. This prevents inadvertent and unanticipated clutch slippage. The operation of the governor valve 70 to automatically reduce the engine speed signal as the supply air pressure drops is disclosed and more fully described in my copending application Ser. No. 715,680 filed Aug. 19, 1976 for "Marine Propulsion Control System". Briefly, as soon as the pressure within the selected clutch falls to the level of the speed signal pressure in the operating line 20 plus the force of the spring 87, the diaphragm follower 86 will move up. This will initially cause the supply valve 90 to close thereby disconnecting the operating line 20 from the relay valve 33. If the pressure then stabilizes at the balanced condition, the follower 86 will not move further and the exhaust valve 88 will remain closed. If the clutch pressure drops beneath the combined counterbiasing forces, the exhaust valve 88 will also open to connect the operating line 20 to the exhaust port 80. The operating line 20 will vent through the regulator valve 71 to thereby lower the pressure in the operating line (and therefore the engine speed) until the combination of the speed signal pressure and the spring force equal the internal clutch pressure, at which time both the exhaust valve 88 and supply valve 90 will be closed. The venting through the regulator valve 71 will occur so long as the air pressure being vented exceeds the dial setting of the regulator valve 71. If the clutch pressure changes up or down the speed signal pressure will be changed proportionally without a change in throttle lever position. If the throttle lever 13 is thereafter moved to reduce the engine speed, the lower pressure which will result in the lines 51 and 73 will be matched in the operating line 20 by having the operating line 20 vent through the check valve 95.

The regulator valve 71 will function to pass the speed control air pressure signal of the line 15 to the exhaust port 80 of the governor valve 70 and thereafter through the governor valve 70 to the control line 20 so long as the governor valve 70 has not been actuated or piloted to close its exhaust valve 88. The governor valve 70 is not actuated or piloted until the air pressure within the clutch being engaged reaches a predetermined level. Consequently, the air pressure signal in the line 15 will be imposed upon the engine governor 21 as the selected clutch is being engaged to thereby increase the engine speed over idle. The engine speed which is selected can never, however, exceed the speed which has been selected at the control station by the positioning of the throttle lever 13. Furthermore, the speed can never exceed a preselected level established by the dial setting of the regulator valve 71.

The operation of the regulator valve 71 can be more fully appreciated by reference to an example operation of the system as a whole. In a typical system, the control would be designed to utilize air from the ship's compressed air supply at 140 psi normal and at a minimum of 125 psi. The throttle governor 21 would respond to pressure signals of 30 to 70 psi. The master control valve 37 would be set to be piloted at a first control pressure of 25 psi and the relay valve 33 would be adjusted to provide a range of between 0 and 70 psi in output pressure. The boost valve would be adjusted to be piloted at a second control pressure of 70 psi, and the throttle governor valve 70 would be provided with a bias spring force of 45 psi.

If the throttle lever 13 is now moved from neutral at least five degrees either ahead or astern, the four-way selector valve 31 will shift thereby selecting either the ahead or astern clutch 22 or 23 which is then connected to receive air through the selector valve 31. The control would be adjusted to begin clutch engagement and to obtain a maximum clutch slip at a 10° handle position which will correspond to about a 15 psi pressure passing through the relay valve 33, the master control valve 37, and the selector valve 31 to the selected clutch. As the throttle lever 13 would be moved further away from neutral, air pressure proportional to the position of the lever 13 will be fed to the selected clutch to continue inflation of the clutch and air pressure proportional to the position of the lever will be fed to the engine governor 21 to increase the speed of the engine beyond idle. When the pressure through the relay valve 33 increases to 25 psi, the master control valve 37 will be piloted thereby closing the connection between the relay valve 33 and the clutch selector valve 31 and replacing it with the connection through the choke valve 39. This would occur at about a 30° handle position. Thereafter, the inflation of the selected clutch is controlled by the choke valve 39 and not by continued movement of the throttle lever 13. For a clutch pressure between 25 to 70 psi supply air is passed to the selected clutch through the choke valve for a soft clutch engagement. When clutch pressure reaches 70 psi, the boost valve 40 shifts to bypass the choke valve 39 and directly connects the clutch to the supply air line 19.

During this same time the lever 13 will be controlling the speed signal to the engine governor to boost the engine speed beyond idle to prevent stalling of the engine. This will occur up to maximum speed signal pressure set for the regulator valve 71. Increases in speed signal in pressure beyond the setting of the regulator valve 71 will not be reflected at the output of the governor valve but instead the maximum set pressure will be maintained. In the typical system being described, the maximum set pressure for the regulator valve 71 may be 40 psi. Thus, a speed signal pressure of from 0 to 40 psi will be passed by the regulator valve 71 through the governor valve 70 to the throttle governor 21. As soon as the pressure exceeds 30 psi, the engine speed will be increased.

When the clutch has been inflated to an internal pressure sufficient to overcome the spring bias of 45 psi and the control line 20 pressure, the governor valve will actuate and close the exhaust valve and open its main supply valve. Thereafter, the speed signal reflected by the throttle lever position will be directed to the engine governor 21 through the governor valve 70 from its input 72 connected to the output 35 of the relay valve 33. The speed signal directed to the throttle speed governor 21 will increase in proportion to the movement or position of the throttle lever 13 up to a maximum signal pressure of 70 psi which will be full engine speed.

Figure 4:
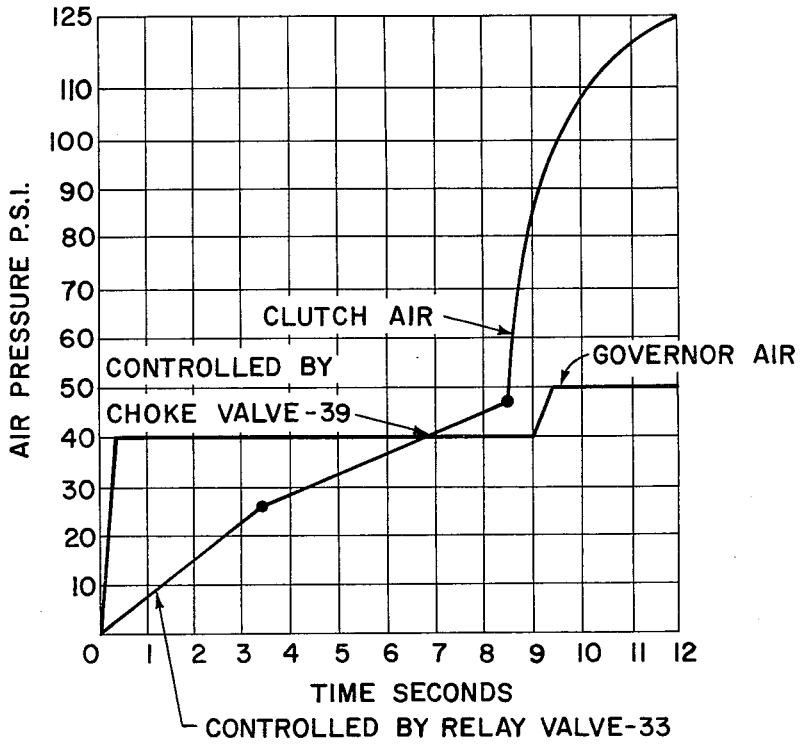
FIG. 4 is a graphical representation of the operation of a system constructed in accordance with the present invention after the throttle control has been rapidly moved from a neutral position to a specific selected position.

In FIG. 4 two curves are shown. One represents the change in the internal clutch pressure for the selected clutch and the other the change in governor throttle speed signal pressure, as the throttle lever is moved rapidly from a neutral position to a half full speed position. The curves illustrate the effect of the regulator valve on the governor speed signal in relation to the engagement of the selected clutch. The curves are drawn for the system described above in the example and they assume that the throttle lever 13 has been moved from neutral to a position where a 50 psi governor speed signal is produced in the line 15.

Referring first to the curve which describes the inflation of the clutch, from the beginning of its inflation and up to a first control pressure of 25 psi, the clutch is controlled by the relay valve 37. From that point until the piloting of the boost valve 40, the clutch inflation is controlled by the choke valve 39. At the second control pressure of 70 psi, the boost valve 40 will be actuated and will allow the full supply air pressure to complete the inflation of the selected clutch.

From time zero, the governor speed signal will first rise rapidly to the maximum pressure setting of the regulator valve 71, because the speed signal pressure exceeds the maximum pressure setting of 40 psi. Thereafter the maximum pressure setting of 40 psi would be maintained until the governor valve 70 is actuated to disconnect the regulator valve 71 and instead connect the outlet 35 of the relay valve 33 to the control of the governor throttle 21. In the example, this would occur at an internal clutch pressure of 85 psi (45 psi spring bias plus 40 psi in the control line 20). Thereafter the governor signal will rise rapidly with time up to its commanded throttle setting of 50 psi. Without the engine idle boost provided by the present invention, the governor speed signal would not exceed idle speed pressure until the governor valve 70 was actuated.

I claim:

1. In a pneumatic clutch control system for a marine propulsion system having a prime mover controlled by a throttle speed governor, a drive train for transmitting power from the prime mover to a propeller drive shaft, an air inflatable clutch for selectively connecting the prime mover to said drive train, throttle means for actuation of the propulsion system, and inflation means responsive to movement of said throttle means for inflating said clutch and including a valve responsive to said throttle means and connected to a source of pressurized air to provide an air output signal at a pressure proportional to throttle position, the combination therewith of:

a governor control valve having a first inlet connected to receive said air output signal, a second inlet, and an outlet connected to said throttle speed governor; and pressure regulator means connected to receive said air output signal and to pass the same to said second inlet of said governor control valve, said regulator means being adjustable to limit the maximum pressure which it passes to said governor valve, said governor valve being normally biased to a position in which said second inlet is connected to said outlet and adapted to be actuated to connect said first inlet to said outlet when the clutch pressure rises above a minimum level.

2. A clutch control system in accordance with claim 1 wherein, said governor valve is actuated when the clutch pressure increases beyond the sum of the biasing force and the air pressure at the outlet of said governor valve.

3. A pneumatic clutch control system for a marine propulsion drive including a prime mover controlled by a throttle speed governor, a drive train for transmitting power from the prime mover to a propeller drive shaft, an air inflatable clutch for connecting the prime mover to said drive train, and throttle means for actuation of the propulsion system, said control system being adapted for connection to a source of pressurized air and comprising:

first and second air branches each leading from said air source to a main control valve which is shiftable to connect one or the other of said air branches to said clutch, said first air branch including means operatively connected to said throttle means to provide an air output that is responsive to air pressure supplied to said first branch by said throttle means;

said main control valve being responsive to the air output from said first branch to disconnect said first branch and connect said second branch to said clutch when said air output reaches a first control pressure;

said second air branch continuing the inflation of said clutch without further control of said throttle means;

a throttle governor control means adapted to provide a speed pressure signal to said throttle speed governor which is proportional to the air pressure supplied to said first branch by said throttle means; and a pressure regulator valve connected to receive said air pressure supplied to said first branch by said throttle means and to pass the same to said throttle governor control means, said throttle governor control means including a governor valve normally urged to a first position by a biasing force and being shiftable to a second position in which said first air branch is connected to said governor when the clutch pressure exceeds the sum of the biasing force and said speed pressure signal, said governor valve in said first position connecting the air pressure output of said regulator valve to said governor.

4. A clutch control system in accordance with claim 3 wherein, said regulator valve is settable to a maximum pressure which it will pass to said throttle governor control means.

* * * * *